US012234064B2

(12) United States Patent
Gebbink et al.

(10) Patent No.: US 12,234,064 B2
(45) Date of Patent: Feb. 25, 2025

(54) SEALING DEVICE FOR SEALING A RECEPTACLE

(71) Applicant: SMARTSEAL AS, Stavanger (NO)

(72) Inventors: Jeroen Gerrit Anton Gebbink, Helmond (NL); Rune Kristian Knutsen, Stavanger (NO)

(73) Assignee: Smartseal AS, Stavanger (NO)

( * ) Notice: Subject to any disclaimer, the term of this patent is extended or adjusted under 35 U.S.C. 154(b) by 212 days.

(21) Appl. No.: 17/622,228

(22) PCT Filed: Jun. 29, 2020

(86) PCT No.: PCT/EP2020/068291

§ 371 (c)(1),
(2) Date: Dec. 22, 2021

(87) PCT Pub. No.: WO2020/260709

PCT Pub. Date: Dec. 30, 2020

(65) Prior Publication Data

US 2022/0348386 A1 Nov. 3, 2022

(30) Foreign Application Priority Data

Jun. 28, 2019 (NL) ..... 2023402

(51) Int. Cl.
*B65D 47/04* (2006.01)
*B65D 47/24* (2006.01)

(52) U.S. Cl.
CPC ..... *B65D 47/248* (2013.01)

(58) Field of Classification Search
CPC ..... B67D 3/043; B67D 3/045; B65D 47/248; B65D 47/32; B65D 47/283
(Continued)

(56) References Cited

U.S. PATENT DOCUMENTS 3,263,875 A * 8/1966 Lofdahl ..... B67D 3/042 222/518
4,570,826 A * 2/1986 Fattori ..... B65D 47/2025 222/89
(Continued)

FOREIGN PATENT DOCUMENTS

EP 2040991 B1 12/2016
JP 2015511914 A 4/2015
(Continued)

OTHER PUBLICATIONS

International Searching Authority; Notification of transmittal of the international search report and the written opinion of the International Searching Authority, or the declaration for Int'l patent application No. PCT/EP2020/068291, Information on search strategy for Int'l patent application No. PCT/EP2020/068291, and international search report for Int'l patent application No. PCT/EP2020/068291; 8 pages; mailed Dec. 4, 2020.
(Continued)

*Primary Examiner* — Charles P. Cheyney
(74) *Attorney, Agent, or Firm* — McDonnell Boehnen Hulbert & Berghoff LLP

(57) ABSTRACT

The present disclosure relates to a sealing device (1) for sealing a receptacle, the sealing device comprising: —a base (3) comprising a discharge conduit (8), —a valve (4) mounted on the base, the valve comprising a discharge pipe (10) at least partially protruding in the discharge conduit of the base and an end mounted on an upstream end of the discharge pipe, —wherein the end of the discharge pipe is configured to, at least in one mode of the sealing device, cooperate with the discharge conduit to thereby seal the discharge conduit of the sealing device, —wherein the base is configured to be mounted on a receptacle, —the base and
(Continued)

the valve are integrally connected at a portion of the sealing device remote from the discharge conduit.

19 Claims, 13 Drawing Sheets

(58) Field of Classification Search
USPC ..... 222/518
See application file for complete search history.

(56) References Cited

U.S. PATENT DOCUMENTS 6,213,351 B1 * 4/2001 Stoneberg ..... B65D 50/061 222/525
6,951,295 B1 10/2005 Gaus et al.
7,040,514 B2 * 5/2006 Colan ..... B67D 1/0456 222/513
7,878,373 B2 * 2/2011 Lindmayer ..... B65D 47/2062 222/211
8,567,647 B2 * 10/2013 Naesje ..... B65D 47/247 222/525
2004/0060598 A1 * 4/2004 Danby ..... A47G 19/2266 137/508
2008/0230570 A1 * 9/2008 Smith ..... B65D 47/283 222/518
2009/0302071 A1 12/2009 Naesje et al.
2011/0042420 A1 * 2/2011 Totten ..... B67D 3/043 222/518
2011/0042421 A1 * 2/2011 Smith ..... B65D 77/067 222/518
2015/0028043 A1 1/2015 Naesje et al.
2015/0274385 A1 * 10/2015 Zoppas ..... B65D 41/0492 215/329
2016/0304332 A1 * 10/2016 Georgelos ..... B32B 3/08
2020/0180825 A1 * 6/2020 Nini ..... B65D 47/30

FOREIGN PATENT DOCUMENTS

WO 2006028378 A1 3/2006
WO 2008016307 A1 2/2008
WO 2020/260706 A1 12/2020

OTHER PUBLICATIONS

International Searching Authority; Written opinion of the International Searching Authority for Int'l patent application No. PCT/EP2020/068291; 11 pages; mailed Dec. 4, 2020.

* cited by examiner

SEALING DEVICE FOR SEALING A RECEPTACLE

The present disclosure relates to a sealing device for sealing a receptacle, an assembly comprising a sealing device and a receptacle, and a method of producing a sealing device.

BACKGROUND OF THE DISCLOSURE

The present disclosure relates to sealing devices for opening and closing a discharge opening of a receptacle, such as a spout of a spouted pouch container, a container as such, for instance a bottle, carton, cup or a can, or similar holder for keeping drinkable (carbonated or non-carbonated) liquids. A problem arising with many types of sealing devices is that they allow for unintentional opening of the sealing devices for undesirable invasion of an aseptic solution, which otherwise is used for bactericidal treatment of the valve and associated components.

A further drawback of existing sealing devices may be that the used valve construction is such that an overpressure in the drinking receptacle may push the sealing plug in a downstream direction and out of its sealing seat within the discharge opening, whereby the valve may open unintentionally.

In EP 2 040 991 B1 an improved sealing device is described that is structured to be able to arranged in different modes or positions: an open utility position, in which the valve of the sealing device is open, a closed utility position, in which the valve of the sealing device is closed in a normal manner (with the sealing device in use), and in a closed storage position wherein the valve is more firmly closed than in the normal manner, in order to ensure that the likelihood of the valve remaining closed is increased. The known sealing device provides a gas-tight sealing in the (closed) storage position (whereas in the closed utility position the sealing needs to be liquid-tight only). The closed storage position is in the present disclosure also simply referred to as the storage position. For instance, the valve may be arranged in the closed storage position when the sealing device is stored or transported between the manufacturing site and the filling site. Alternatively or additionally, the sealing device may be kept in the storage position right after the sealing device has been connected to a receptacle and the receptacle has been filled with content, for instance during transportation thereof from the assembly site to the store, and before the sealing device has been opened for the first time by the end user.

In other words, EP 2 040 991 B1 discloses that, the sealing device is structured so that in the storage mode/position, the sealing device functions as a good seal in connection with filling, packing, transport and storage of a beverage in a (drinking) receptacle. In the closed utility mode/position, the sealing device is also structured to function as a good seal in connection with consumption of the beverage in the drinking receptacle, hereinafter termed a utility seal. Upon consumption, the valve is normally opened and closed repeatedly, and the sealing device is therefore structured to be able to function satisfactorily also in context of this type of application.

However, during manufacturing of the known sealing device three separate components are made, i.e. a base that is to be connected to a drinking receptacle, a valve that is accommodated in the base and a protective cover that surrounds the base and valve and is used to attach both the base and the valve to the drinking receptacle. After having made the three separate components, first the base is placed on the drinking receptacle, then the valve is positioned in the base and finally the protective cover is used to attach the base and valve to the drinking receptacle. This means that both the manufacturing of the components of the sealing device and the attachment thereof to the drinking receptacle are performed at one and the same position (i.e. the manufacturing site). Only after assembling in this manner a drinking receptacle with a sealing device, the combination of receptacle and connected sealing device can be transported to the cleaning and/or filling site, remote from the manufacturing site.

This operation has a number of disadvantages. For instance, it is difficult to fulfill all requirements as to hygiene when the sealing device must both be manufactured and attached to the drinking receptacle at the same position (site). Furthermore, the protective cover is necessary in order to be able to connect the base and the valve accommodated in the base to the drinking receptacle and to keep the base and valve together. Without the protective cover the base and valve cannot be attached to the receptacle.

WO 2006/028378 A1 discloses in a first example shown in FIGS. 1 and 2 an underpressure-activated sealing device comprising a cap 4 consisting of a lying (horizontal) end wall 6 and an upright (vertical) circular mantel 8, and an operating member including a spout 38 attached to the cap 4. The operating member is mounted within an external, collar-shaped housing 48 arranged in a circle on the top side of the horizontal end wall 6 and attached thereto using a snap coupling 46. On top of the horizontal end wall a protective cap 60 may be releasably arranged. Mounting the known operating member in this manner to the top side of the horizontal end wall 6 has a number of disadvantages. First of all, there is a risk of collection of dirt at the outer surface of the sealing device, especially at the position of the collar-shaped housing and the snap-coupling between the collar-shaped housing and the operating member. Furthermore, the manufacturing and/or assembling operation of the sealing device is relatively complex allowing, while it is sometimes difficult to provide and maintain an adequate sealing quality between the operating member and the collar-shaped housing on the horizontal end wall 6 of the cap 4.

Overview

An aspect of the present disclosure remedies or at least partially avoids the disadvantages of the known valve technology in the present area.

Another aspect provides a sealing device that can more easily be made to comply with high standards as to hygiene, while still allowing a more versatile and/or a less complex manufacturing and assembling operation of the sealing device.

Another aspect provides a sealing device wherein the risk of unintentional opening of the valve as a result of overpressure in the receptacle or in the container associated with the receptacle is not increased, or even reduced.

According to a first aspect of the present disclosure there is provided a sealing device for sealing a receptacle, for instance a spout or a drinking receptacle. The sealing device comprises a base structured to be mounted to the receptacle, the base comprising a sleeve forming a discharge conduit. The sealing device also comprises a valve arranged on the base. When the base is mounted to the receptacle, the receptacle is located upstream of the valve and the discharge direction of the receptacle defines a downstream direction, opposite an upstream direction. The valve comprises a discharge pipe at least partially protruding in the sleeve of the base and being axially movable therein in the upstream and downstream direction for opening and closing the valve. The valve is attached to the base at a portion of the sealing device remote from the discharge conduit.

Since the base and the valve are attached in a portion remote from the discharge conduit, the sealing device may provide a reliable seal, at least in one mode of the sealing device. Furthermore, by attaching the valve to the base, they can be more easily transported, for instance from the manufacturing site to a cleaning and/or filling site, while still ensuring that the valve remains properly accommodated in the base. This makes it possible to geographically separate the manufacturing area wherein the components of the sealing device (i.e. the base and valve) are made, from the assembly area wherein the sealing device is connected to the receptacle or container so that one more easily can meet the different requirements that apply in these distinct areas. The manufacturing area and assembly area could be remote areas, hundreds of kilometers away from each other.

In an embodiment of the present disclosure wherein the base comprises a tubular base wall and the valve comprises a tubular attachment wall, the tubular attachment wall may be configured to be arranged over the tubular base wall, for instance because the diameter of attachment wall of the valve is only slightly larger than the diameter of the tubular base wall. Preferably the tubular base wall is configured to snugly fit inside the tubular attachment wall of the valve so as to improve the seal between the base and valve and/or to make the manufacturing process (that may involve welding the tubular base wall to the tubular attachment wall of the valve) easier. Once the tubular attachment wall arranged is over the tubular base wall, for instance because the tubular base wall is slid into the tubular attachment wall of vice versa, the tubular attachment wall is attached to the tubular base wall at a portion remote from the discharge position.

In a further embodiment the valve is attached with its lowermost portion of the tubular attachment wall to the tubular base wall of the base. The valve may even be attached with its lowermost portion of the tubular attachment wall to the lowermost portion of the tubular base wall of the base.

In an embodiment the base comprises a radially protruding base collar and the valve comprises a radially protruding valve collar, wherein the base collar is fixedly attached to the valve collar, and wherein the base collar and the valve collar define said portion of the sealing device remote from the discharge conduit. The base collar and the valve collar may be portions of the base and valve respectively that may be configured to provide a suitable fixing position for fixing of the valve to the base. Preferably, the base collar and the valve collar are arranged in the upstream direction of the sealing device. Thereby, damage on the position where the valve is attached to the base may be prevented, since the downstream direction of the sealing device may most often come into contact with other objects.

Further, the base collar and the valve collar may be joined via any of gluing, heat welding, ultrasonic welding, RF welding, pressure welding and/or impact welding, preferably ultrasonic welding, mechanical fitting such as snap fitting. Thereby a reliable connection between the base and the valve may be obtained.

In an embodiment the base collar extends along the entire circumference of the base, preferably along the circumferential bottom edge of the tubular bas wall of the base, and/or wherein a valve collar extends along the entire circumference of the valve, preferably along the circumferential bottom edge of a tubular attachment wall of the valve. This may create a reliable liquid-tight—or even gas-tight-sealing and/or a constructionally strong attachment between the valve and base of the sealing device.

In an embodiment the base collar is attached directly to the valve collar, for instance by gluing or welding a surface of the base collar to a corresponding surface of the valve collar. Alternatively or additionally, the base collar is attached indirectly to the valve collar via a ring-shaped attachment element, for instance a clamping ring. The ring-shaped attachment element may comprise at least one attachment portion extending in a radially inward direction to contact the protruding base collar and/or the radially protruding valve collar, both collars arranged to extend radially outward.

In further embodiments wherein the sealing device comprises a clamping ring, the clamping ring may be fixedly attached to or be integrally formed with the base collar or the valve collar. The clamping ring may be attached at least to the base collar and may be protruding in a radially inward direction of the sealing device over the radially protruding portion of the valve collar to thereby attach the valve to the base. The clamping ring may be attached to the base collar using any of gluing, heat welding, ultrasonic welding, RF welding, pressure welding and/or impact welding, preferably ultrasonic welding. Preferably the clamping ring may also be attached to the valve collar using any of gluing, heat welding, ultrasonic welding, RF welding, pressure welding and/or impact welding, preferably ultrasonic welding, further preferably, wherein the clamping ring may be attached to the valve collar in the same manner and/or same step as the base collar may be attached to the clamping ring, even further preferably, the valve collar, base collar and clamping ring may be integrally joined in one step using any one of gluing, heat welding, ultrasonic welding, RF welding, pressure welding and/or impact welding, preferably ultrasonic welding.

In further embodiments the attachment element (for instance the clamping ring) is pivotably attached to or pivotably formed with the base collar or the valve collar. The attachment element then only needs to be attached (glued and/or welded) to the other collar.

Furthermore, the base collar may comprise one or more welding elements configured to connect to the ring-shaped attachment element using ultrasonic welding. A benefit of the base collar comprising one or more welding elements is that the ring-shaped attachment element may be welded with exact distance from the base, thereby creating a controlled pressure on the valve. The valve will be locked with a reduced likelihood of coming lose.

The welding element may be implemented as a line formed along surface of the base collar in the downstream direction of the sealing device. Alternatively, the welding elements may be implemented as a welding line which may be formed on the clamping ring configured to be arranged on the upstream direction thereof for accommodating welding of the clamping ring to the base collar.

In some embodiments the base collar may be provided with one or more welding elements of a type wherein the welding elements point in a downstream direction of the sealing device. The welding elements may be configured to be welded to a side of the valve.

Further, the welding elements may each be provided with a welding tip facing the valve. The welding tip may be configured to provide additional material for the purpose of welding to thereby establish a reliable connection.

In an embodiment at least one of a group comprising the base, the base collar, the valve collar, and the upstream side of the valve, is provided with one or more connection elements, wherein a portion of the base, the base collar, the valve collar, and/or upstream side of the valve is provided with one or more connection holes, wherein the connection holes are provided in the portion of the base, the base collar, the valve collar, and/or upstream side of the valve that is opposite to a position where the one or more connection elements are arranged, wherein the connection holes are configured to allow the connection elements to protrude through the connection holes, and wherein the connection holes and connection elements are configured to co-operatively fix the valve to the base. Preferably, the outer end of the connection element may be an arrow-like shape, a mushroom-like shape, a diamond-like shape or the like. Further preferably, the outer diameter of the outer end of the connection element may have an increased diameter with respect to e.g. a middle portion of the connection element, and preferably the outer diameter of the outer end of the connection element may be slightly larger than the inner diameter of the connection hole (e.g. >101%, >110%, or >150% the diameter thereof). For example, the connection elements may be arranged on the base, preferably close to the base collar, while the connection holes are arranged in the valve. Thereby, the one or more connection elements may be forces through the connection holes. Hereafter, a substance force may be required to force the connection elements out of the connection holes, or in some embodiments, it may be impossible to force the connection elements out of the connection holes. Hereby a reliable connection between the base and the valve may be obtained.

In an embodiment the base collar comprises one or more clamping elements. The clamping elements may be configured to clamp at least a portion of the valve collar to thereby fix the valve collar to the base collar. Such clamping elements may allow relatively simple connection of the valve to the base. Further, in some embodiments it may be possible to manually disengage the base and the valve if required by forcing the one or more clamping elements outwards thereby allowing removal of the valve form the base.

Furthermore, the base collar may comprise a clamping ring integrally formed with the base collar, wherein the clamping ring fixes the valve collar to the base collar in a click-like-manner Such a clamping ring may allow relatively simple connection of the valve to the base since the valve is pushed in an upstream direction until the valve collar clicks into the clamping ring.

A further issue associated with some types of prior art sealing devices is that unwanted materials like dirt, impurities and the like may invade the sealing device in the time period after manufacturing and before the associated container is filled with liquid, i.e. during storage of the sealing device for later use. During storage the sealing devices may be transported from the manufacturing site to the assembly site (where the sealing device is attached to the receptacle) and from the assembly site to the filling site (where the container associated with the receptacle is filled). During storage and transport the valve of the known sealing devices may be displaced to the extent that no full sealing by the sealing device is provided. This may cause a number of problems when the sealing devices arrive at the assembly site and/or filling site where the sealing device are to be thoroughly cleaned. For instance, for hygienic reasons, the sealing device may be immersed into a heated aseptic solution containing a bactericide fir aseptic treatment. Subsequently, when the aseptic treatment is ended, liquid residues may end up in the sealing device which residues are visually unappealing and may inflict foul taste in the beverage during consumption thereof.

The sealing device may be structured to be able to arranged in different modes or positions: an open utility position, in which the valve of the sealing device is open, a closed utility position, in which the valve of the sealing device is closed in a normal manner (with the sealing device in use), and in a closed storage position wherein the valve is more firmly closed than in the normal manner, in order to ensure that during storage (incl. transport) the valve always remains closed. The known sealing device may even provide a gas-tight sealing in the (closed) storage position (whereas in the closed utility position the sealing needs to be liquid-tight only). The closed storage position is in the present disclosure also simply referred to as the storage position since in the storage phase—for instance between the manufacturing site and the filling site—the valve should always be closed In other words, in certain embodiments of the present disclosure the sealing device is configured to allow movement of the discharge pipe between different positions, including:

a closed utility position; and an open utility position, wherein in the closed utility position, the sealing device is configured to provide a seal, and wherein, in the open utility position, the sealing device is configured to provide a substantially free liquid passage through the discharge conduit.

The different positions may additionally comprise a storage utility mode wherein the valve of the sealing device valve is more firmly held in a closed position than in the closed utility position.

In embodiments of the present application the discharge pipe comprises a sealing body of a radially flexible arrangement, the sealing body being configured to cooperate with the sleeve for opening and closing of the discharge conduit; and wherein the discharge pipe is configured to be axially movable between a storage position wherein the discharge pipe has been moved in downstream direction to contact a storage seal seat of the sleeve to close the discharge conduit, an open utility position wherein the discharge pipe has been moved in upstream direction to open the discharge conduit, and a closed utility position, arranged between the storage position and the open utility position, wherein the discharge pipe has been moved to contact a utility seal part of the sleeve to close the discharge conduit.

In a preferred embodiment the utility seal portion comprises at least one of an end seal seat and an internal ring-shaped seal portion of the sleeve to be contacted by the sealing body of the axially movable discharge pipe to seal off the discharge conduit.

In further embodiments the base comprises a plurality of base anti-rotation grooves extending in the direction parallel to the downstream direction in an inner portion of the base, wherein the base anti-rotation grooves are configured to cooperate with spout anti-rotation grooves of a spout whereon the sealing device can be mounted.

The present disclosure also relates to the assembly of a sealing device as described herein and a receptacle, wherein the sealing device is mounted on the receptacle. The receptacle may comprise a spout, wherein a base of the sealing device comprises a plurality of base anti-rotation grooves extending in a direction parallel to the downstream direction of the sealing device and being arranged in an inner portion of the base, and the spout may comprise spout anti-rotation grooves, the base anti-rotation grooves being configured to cooperate with the spout anti-rotation grooves of the spout whereon the sealing device is mounted. The spout anti-rotation grooves and the base anti-rotation grooves may cooperatively prevent rotation of the sealing device with respect to the receptacle. In some embodiments, this may be preferable, for example, if at least one of the receptacle and the sealing device does not have a rotationally symmetric shape.

According to another aspect a method of producing a sealing device is provided, the method comprising:

providing a base and a valve that jointly form a sealing device;

arranging the valve on the base, wherein the base comprises a discharge conduit, and the valve comprises a discharge pipe at least partially protruding in the discharge conduit of the base and an end mounted on an upstream end of the discharge pipe, wherein the end of the discharge pipe is configured to, at least in one mode of the sealing device, cooperate with the discharge conduit to thereby seal the discharge conduit of the sealing device, wherein the base is configured to be mounted on a receptacle, and fixedly attaching the valve to the base at a portion of the sealing device remote from the discharge conduit.

Further advantages, features and details of the present disclosure will be elucidated with reference to the description of some examples thereof. Reference is made in the description to the accompanying figures. The figures are schematic and may be somewhat distorted with respect to relative dimensions and position of components relative to one another. In general, similar or corresponding details of the figures will be given the same or similar reference numerals in the following.

DETAILED DESCRIPTION

In the following description, for the purposes of explanation, numerous specific details are set forth in order to provide a thorough understanding of the present disclosure. It will be apparent, however, that aspects of the present disclosure may be practiced without these specific details. In other instances, well-known structures and devices are not described in exhaustive detail, in order to avoid unnecessarily obscuring the present disclosure.

As will be apparent to those of skill in the art upon reading this disclosure, each of the individual embodiments described and illustrated herein has discrete components and features which may be readily separated from or combined with the features of any of the other several embodiments. Any recited method can be carried out in the order of events recited or in any other order which is logically possible.

It is noted that, as used herein and in the appended claims, the singular forms "a", "an", and "the" include plural referents unless the context clearly dictates otherwise. It is further noted that the claims may be drafted to exclude any optional element. As such, this statement is intended to serve as antecedent basis for use of such exclusive terminology as "solely," "only" and the like in connection with the recitation of claim elements, or use of a "negative" limitation.

An example of a sealing device having a storage position to be used when the sealing device is stored, an open utility position to open the discharge passage of the sealing device and a closed utility position to close off the discharge passage of the sealing device is described in WO 2008/016307 A1, the content of which is herein incorporated by reference.

Figure 1:
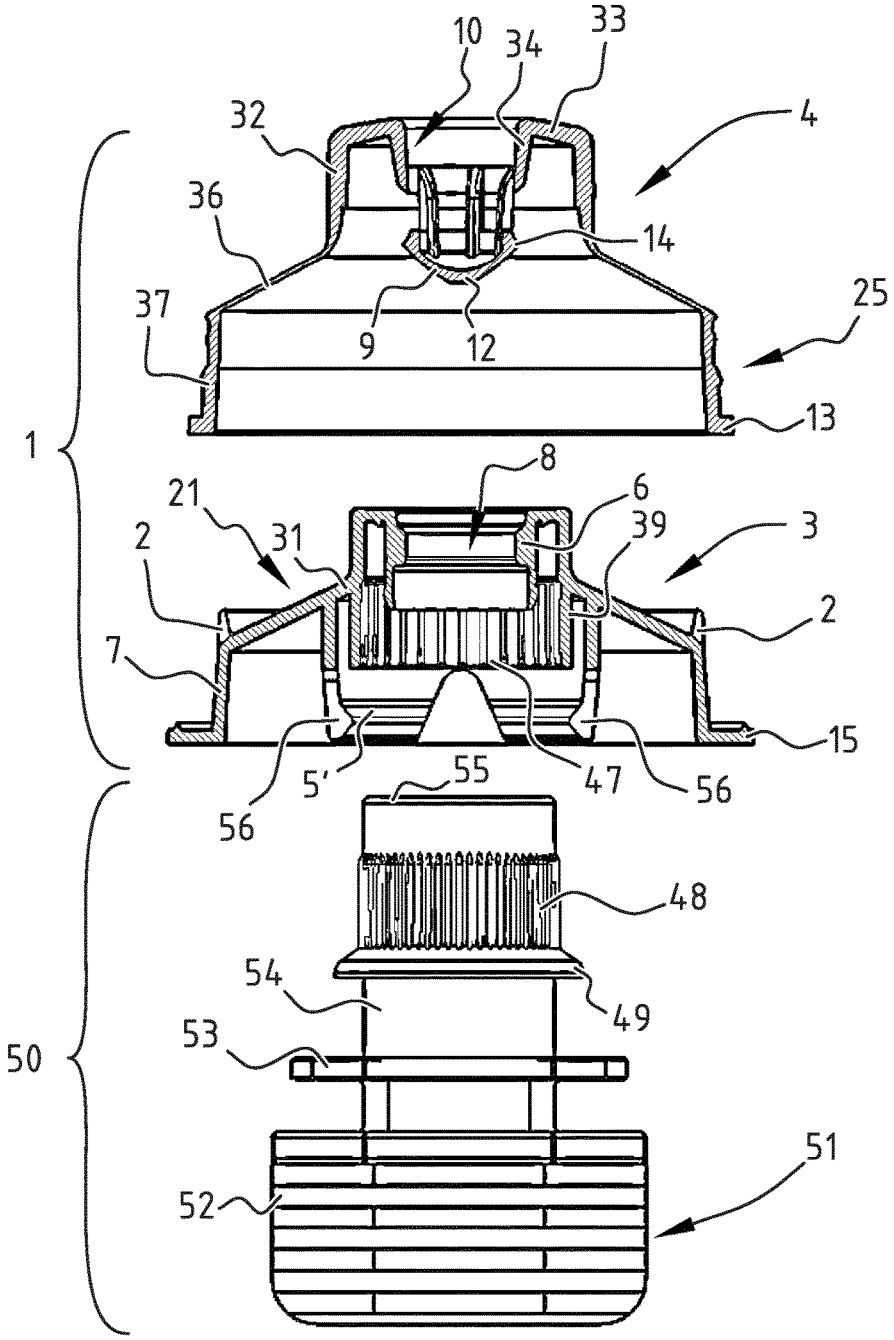
FIG. 1 is an exploded side view, partly cut away, of a first embodiment of a sealing device and on a (portion of a) receptacle.

FIG. 1 illustrates a schematic exploded view of an assembly of a receptacle 50 of a container (the container is not shown, but could be any container or holder able to carry a liquid or liquid-like medium, for instance a flexible spouted pouch container, a bottle, a can, a drinking carton, etc.) and a first embodiment of a sealing device 1 according to the present disclosure.

The sealing device 1 comprises a base 3 (to be) connected to the receptacle 50 and a valve 4 (to be) mounted to the base 3. The base 3 comprises a stationary base housing 21 comprising at least a wall partition 31 and a tubular base wall 7. In further embodiments, for instance the embodiment of FIGS. 2A-2C, the base housing 5 also comprises a tubular connection portion 11, while the base housing 5 may also comprise a cylindrical flange 39, as will be explained later. The base 3 also comprises a discharge conduit 8 in which a base passage (i.e. passage through the base 3) is provided. To this end the base housing 21 may comprise a tubular body 6 (herein also referred as a sleeve 6) as part of the discharge conduit 8.

Similarly, the valve 4 comprises a stationary valve housing 25 to be attached the base housing 21. The stationary valve housing 25 may comprise a tubular attachment wall 37, for instance a tube having a diameter slightly larger than the diameter of the tubular base wall 7 so as to allow the tubular base wall 7 to snugly fit into the tubular attachment wall. The stationary valve housing 25 may further comprise a valve collar 13. The valve 4 also comprises a number of parts that are configured to be movable with respect to the stationary valve housing 25. For instance, the valve 4 comprises a discharge pipe 10 wherein a valve passage is provided. When the valve 4 is positioned on the base 3, the base passage in the discharge conduit of the base 3 and the valve passage in the discharge pipe of the valve 4 together form a closable or sealable passage from the interior of the (container of a) receptacle 50 connected to the sealing device 1 and the exterior, allowing any contents of the container to be dispensed, as will be explained hereafter.

In the shown embodiments, the wall partition 31 extends at least partially radially with respect to the discharge conduit 8. Connected to the wall partition 31 or integrally formed therewith are three concentric axial tubular walls: a tubular base wall 7 with a relatively large diameter, a cylindrical flange 39 having a small diameter, and a ring-shaped connection portion 56 having an intermediate diameter (i.e. a diameter larger than the diameter of the cylindrical flange 39 and smaller than the diameter of the tubular base wall 7). The base 3 further comprises a base collar 15 formed by a generally ring-shaped radially protruding portion of the tubular base wall 7 of the base 3. The base collar 15 is preferably arranged at the upstream free end of the tubular base wall 7.

The valve 4 further comprises an outer tubular wall 32 connected via a top wall 33 to an inner tubular wall 34 of the discharge pipe 10. The outer tubular wall 32 defines a tube with a larger diameter than the inner tubular wall 34 of the discharge pipe 10 to define a gap 35 between the inner and outer tubular walls 34 and 32. Furthermore, the outer wall 32 is formed with a ring-shaped flexible (resilient) wall 36, while the flexible wall 36 in turn is formed with or connected to a tubular attachment wall 37. The flexible wall 36 enables the downstream portion of the valve 4 to be moved in an axial upstream or axial downstream direction relative to the stationary base 3. At the free end of the tubular attachment wall 37 valve collar 13 is formed. The valve collar 13 is configured as a generally ring-shaped radially protruding portion of the tubular attachment wall 37 of the valve 4.

In the shown embodiment the receptacle 50 is a spout 51 comprising a tubular spout member 54 provided at the bottom end with a container attachment flange part 52 that can be attached (for instance welded) in any know manner to the walls of a flexible container, for instance a container formed by welding portions of flexible film material to each other. The tubular spout member 54 is also provided with a transversal flange 53 extending transversally of the axial direction of the spout, the flange being provided for more easy handling of the spouted container, for instance in a labelling machine and/or filling machine. The tubular spout member 54 further comprises a circumferential connection element 49. In the shown embodiment, the circumferential connection element 49 comprises a flange like protrusion that radially protrudes from the tubular spout member 54. Similarly, the base 3 may comprise a ring-shaped connection portion 56. The ring-shaped connection portion 56 may have a flexible lower edge that is configured to engage on the circumferential connection portion 49 of the tubular spout member 54. The ring-shaped connection portion 56 of the base 3 may have an inner diameter matching or slightly less than an outer diameter of the circumferential connection portion 49 of the tubular spout member 54 so as to firmly the base 3, to the drinking receptacle 50. More specifically, the base 3 may be slid over the discharge end of the receptacle 50 and the flexible connection portion 56 of the base 3 may be forcedly slid over the connection portion 49 of the receptacle 50 so that the connection portion 56 clicks over the flange like protrusion of the connection portion 49 of the tubular spout member 54 to thereby fix the sealing device 1 on the receptacle 50.

The outer surface of the tubular spout member 54 may (at an axial position between the connection portion 49 and the discharge end 55) comprise a plurality of external axial ribs/grooves 48. The external axial ribs/grooves are preferably evenly distributed over the circumference of the tubular spout member outer surface. The external axial ribs 48 are configured to engage corresponding ribs/grooves 47 provided inside the base 3 on the inner surface of a cylindrical flange 39 connected to or integrally formed with wall partition 31 (cf. FIG. 1) in order to prevent rotational motion of the base 3 with respect to the receptacle 50. This may reduce unintentional wear due to rotation of the base 3 relative to the receptacle 50 which may otherwise deteriorate the reliability of the connection of the sealing device 1 to the receptacle 50.

Figure 2A:
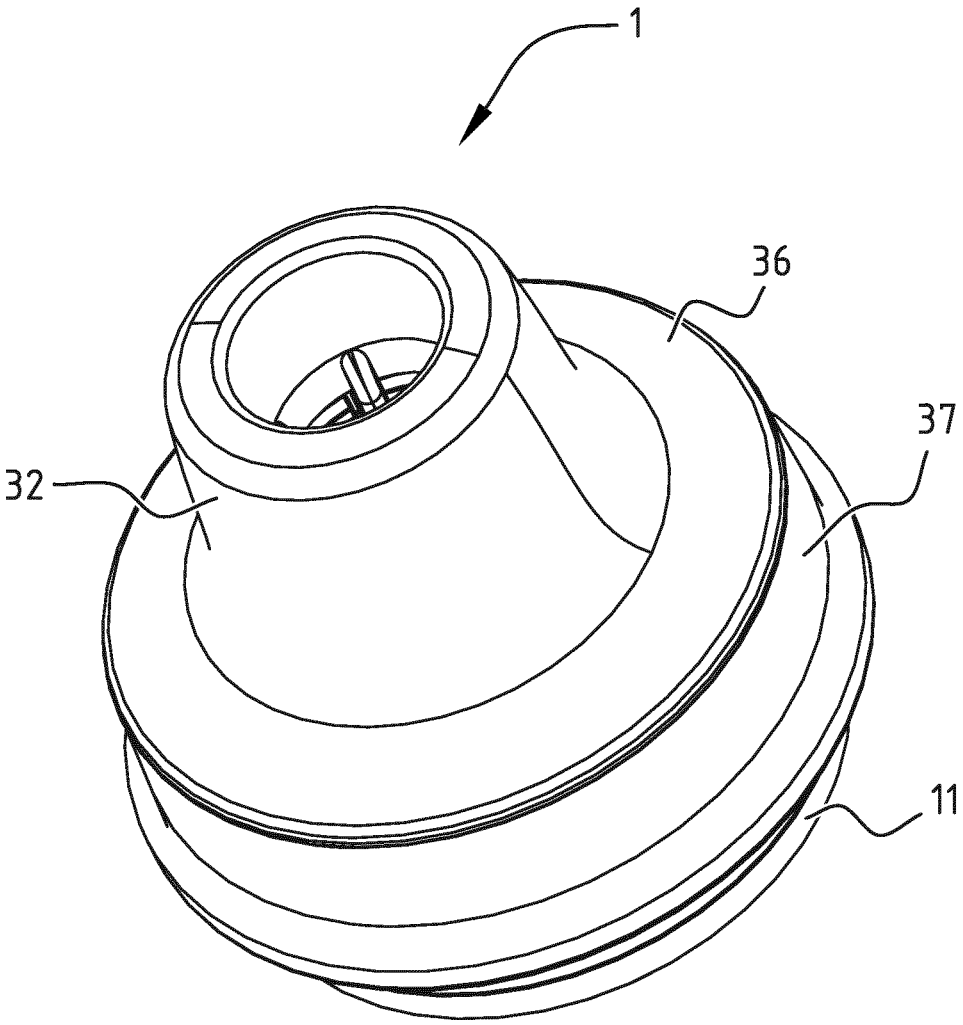
FIG. 2A shows a perspective side view of a second embodiment of the sealing device.
Figure 2B:
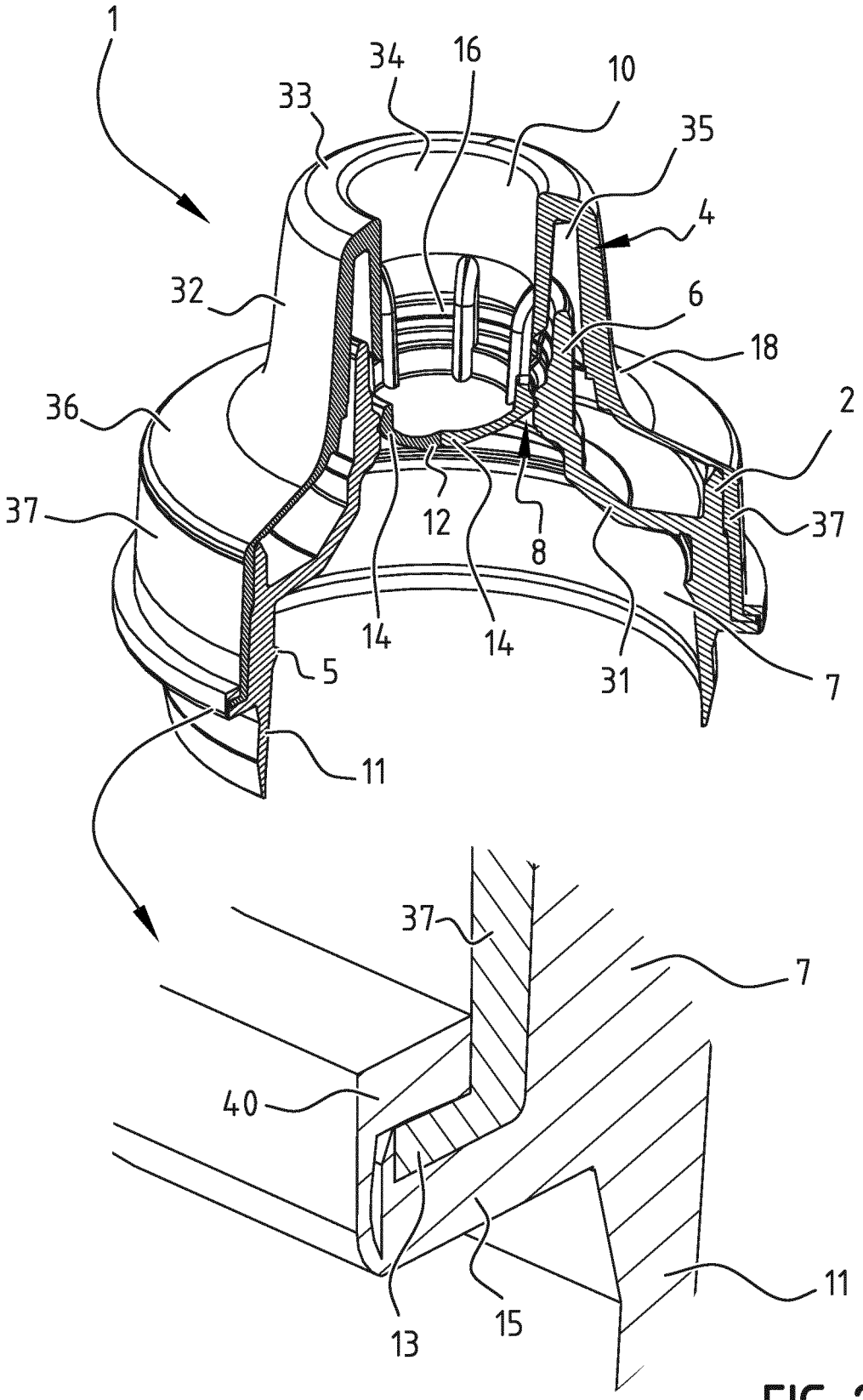
FIG. 2B and FIG. 2C show respective cut-away side views of the second embodiment of FIG. 2A.
Figure 2C:
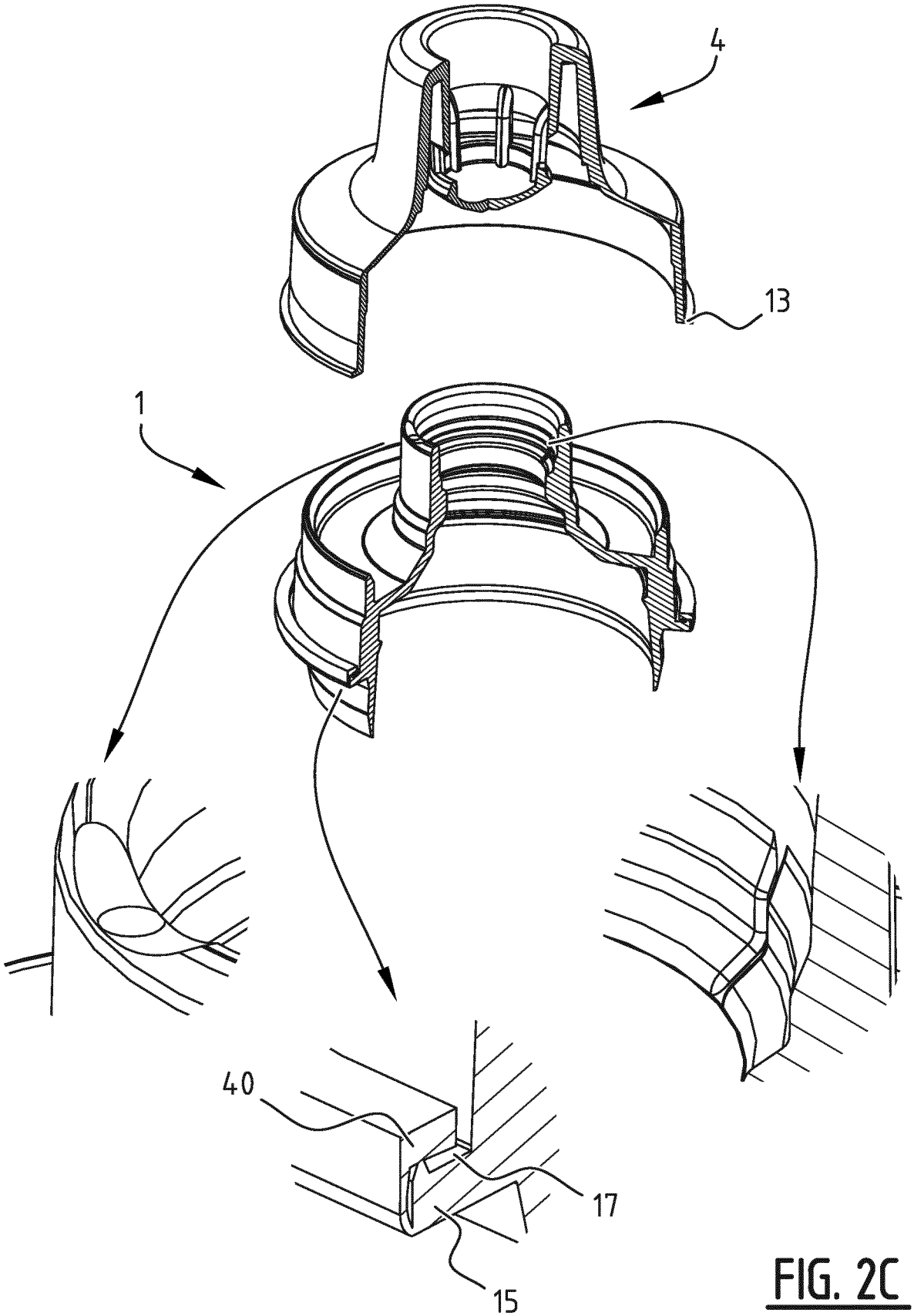
Figure 3A:
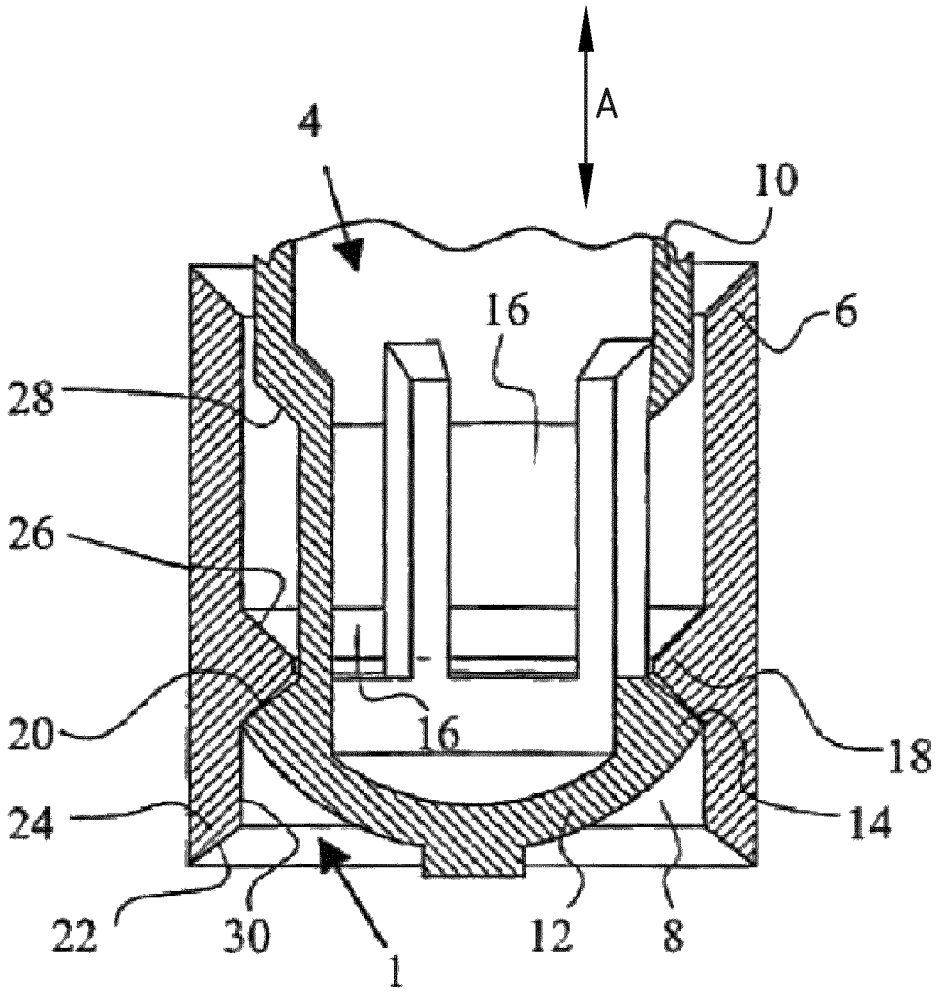
FIG. 3A, FIG. 3B, and FIG. 3C show longitudinal sections through an embodiment of a sealing device, in the storage mode, the open utility mode, and the closed utility mode, respectively.
Figure 3B:
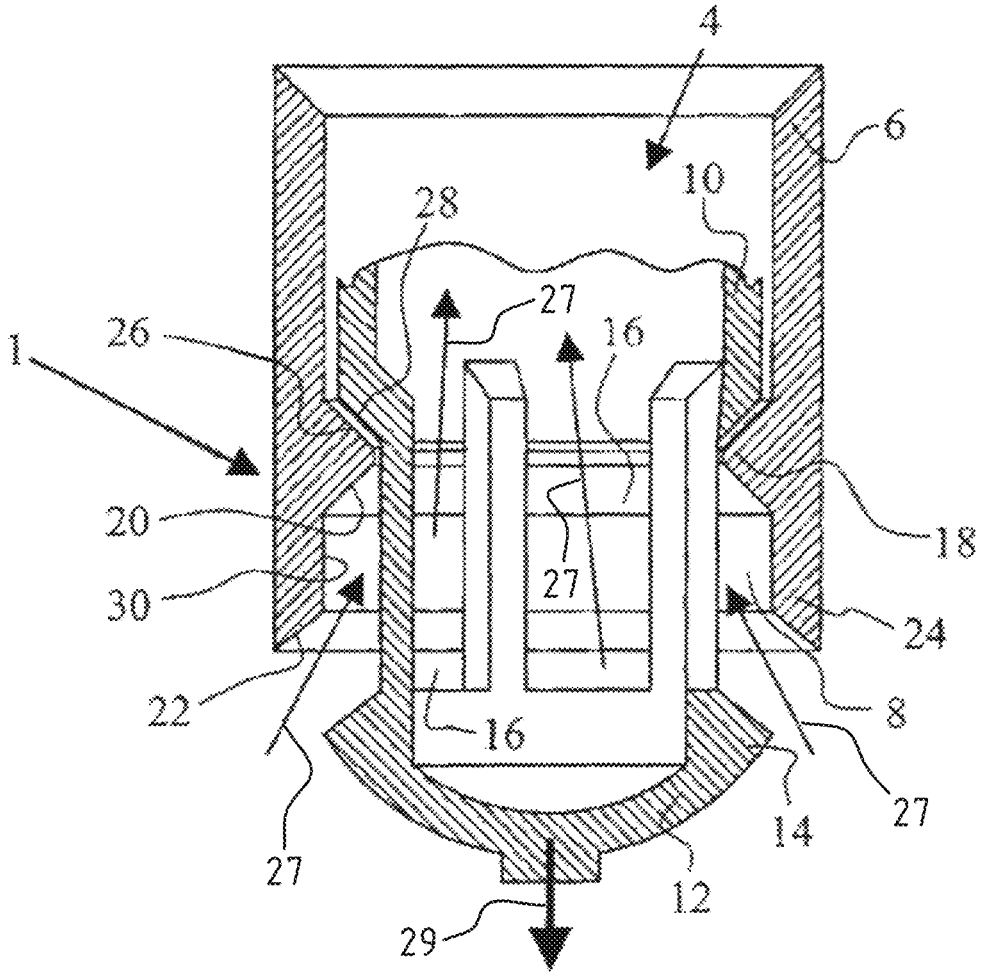
Figure 3C:
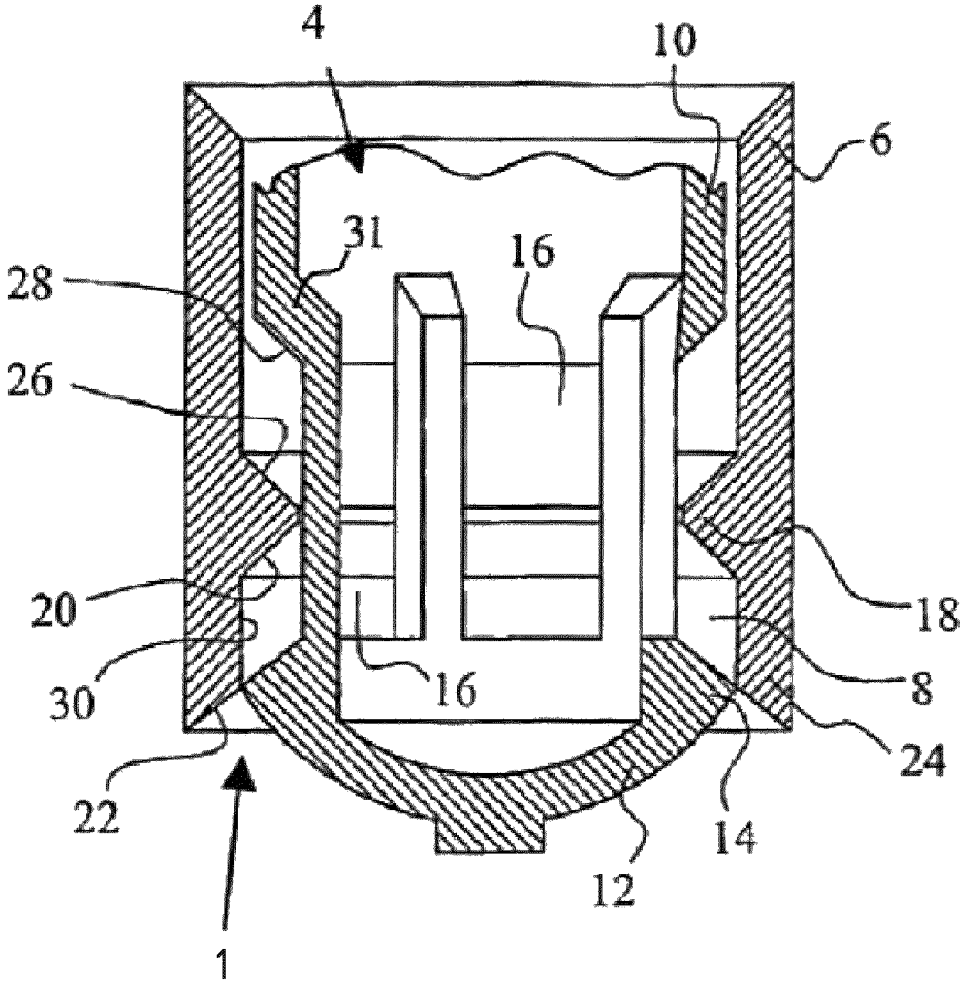

FIGS. 2A-2C and 3A-3B show a second embodiments of a sealing device 1 according to the present disclosure. FIGS. 2A-2C show various side views (FIGS. 2B and 2C being partially cut-away) of (details of) the second embodiment of the sealing device 1. The second embodiment corresponds with the first embodiment except for the absence of the ring-shaped connection portion 56 and the cylindrical flange 39. FIGS. 3A-3C are schematic cross-sections of a further embodiment and show a portion of a sealing device that is in common with the sealing devices of FIGS. 1 and 2A-2C.

While in the first embodiment depicted in FIG. 1 the receptacle 50 is shown to be a spout 51 forming part of a spouted container and the base 3 is attached to the spout 51 using the ring-shaped connection portion 56 arranged inside the base (more specifically inside the volume defined by the tubular base wall 7), the receptacle may also be part of or form another type of container, such as a bottle, for instance a glass or plastic bottle. Also in this case the base 3 of the sealing device may be attached to the receptacle by means of the ring-shaped connection portion. However, the base 3 can also be attached in a different manner to a receptacle. For instance, referring to the second embodiment depicted in FIGS. 2A-2C, a sealing device 1 can be mounted in a different manner on a drinking receptacle, for instance on the discharge end of a bottle. To this end, the sealing device 1 may comprise a tubular connection portion 11 (for instance, formed by a free cylindrical end of the earlier-mentioned tubular base wall 7 of base 3) having an outer diameter matching an inner diameter of a discharge end of the drinking receptacle, such that the sealing device 1 may be fitted in the discharge end of the receptacle. Alternatively, as will be discussed later, the tubular connection portion 11 may have an inner diameter matching an outer diameter of a discharge end of the drinking receptacle such that the sealing device 1 may be fitted over the discharge end of the drinking receptacle.

Figure 5:
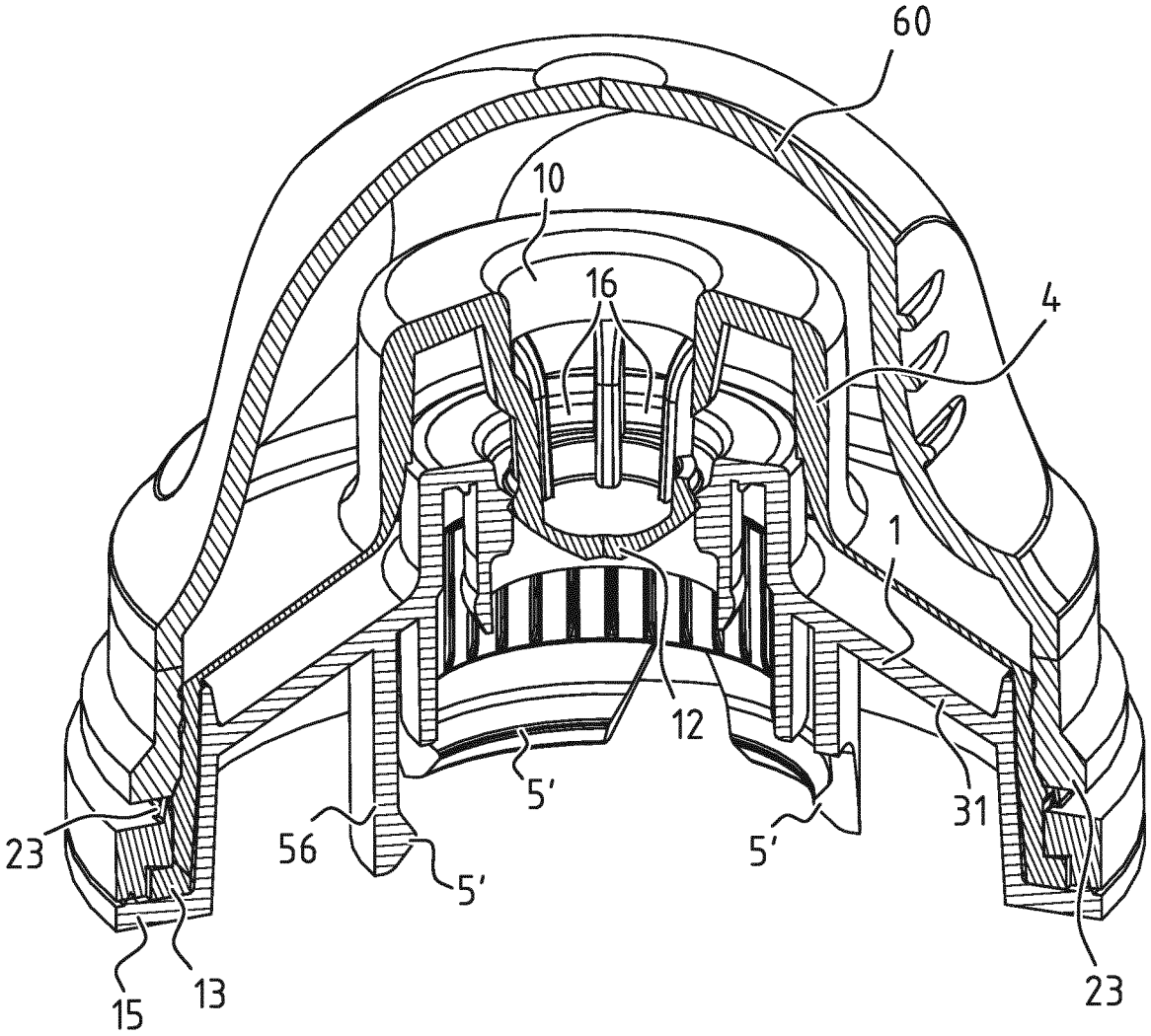
FIG. 5 shows a cut-away side view of a still further embodiment of the sealing device.

On top of the sealing device 1, an over cap 60 (herein also referred to as the covering lid, dust cap or end cap, cf. FIG. 5) may be placed to ensure the aseptic properties of the sealing device 1, for instance during transport and/or storage. Additionally, the over cap 60 may prevent unwanted opening of the valve, for instance in the transport phase of the sealing device from the sealing device manufacturer to the filling site where the container is filled.

Usually the sealing device is manufactured at a first geographical location, made ready for storage and then transported to a second, remote geographical location. Only when the sealing device has arrived at the second location the sealing device is attached to a receptacle of a container. At the same location or at further geographical location the container is then filled with content and made ready of use. The above-mentioned storage mode or position of the sealing device corresponds to the position of the valve 4 right after manufacturing thereof. The sealing device 1 is then ready for storage so as to be transported from the manufacturing site to the assembling and/or filling site wherein the sealing device is connected to a receptacle and wherein the associated containers is (optionally) filled. Once the container is filled, the valve may be kept in the storage position, ready for first opening by the end user.

Referring to FIGS. 2A-2C the valve 4 of the sealing device 1 according to the second embodiment comprises an axially movable discharge pipe 10 comprising an inner tubular wall 34. The inner tubular wall 34 of the discharge pipe 10 is seated inside the short, non-movable tubular body or sleeve 6 of the base 3, the sleeve 6 being part of the discharge conduit 8. The non-movable tubular body/sleeve 6 is herein also referred to as the stationary sleeve 6. FIG. 2B shows that the stationary sleeve 6 is connected to or integrally formed with a surrounding support structure in the form of the wall partition 31. As discussed earlier, the wall partition 31 may be connected to or integrally formed with the tubular connection portion 11 that is configured to allow the base 3 to be firmly connected to the receptacle 50.

As shown in FIGS. 3A-3C, the discharge pipe 10 is arranged coaxially in the sleeve 6 and is movable in axial direction (in the figures, upward and downward) relative to the stationary sleeve 6 between (at least) three different axial positions. The discharge pipe 10 is movable in axial direction and is configured for valve-activation. More specifically, the discharge pipe 10 constitutes a maneuver body in the form of a valve stem which may open or close the passage of liquid through the sealing device 1. The discharge pipe 10 comprises at its upstream end an upstream seal member 12. The upstream seal member may be formed by an end wall 12. This end wall of the discharge pipe 10 is closed, but in the side surface of the discharge pipe 10 one or more radial openings 16 are present allowing liquid to flow from the container, through the base passage and the valve passage to the outside, when the valve is in the open utility position of FIG. 3B.

As shown in FIG. 2B, the inner tubular wall 34 of the discharge pipe 10 is connected via a top wall 33 to an outer tubular wall 32. The outer tubular wall 32 defines a tube with a larger diameter than the inner tubular wall 34 of the discharge pipe 10 to define a gap 35 between the inner and outer tubular walls 34 and 32. Furthermore, the outer wall 32 is formed with a flexible (resilient) wall 36 (cf. FIGS. 1, 2A, 2B), extending obliquely or transversally relative to the axial direction), while the flexible wall 36 in turn is formed with or connected to a tubular attachment wall 37. The tubular attachment wall 37 of the valve 4 can be mounted firmly to the stationary base 3, as will be explained later. The flexible wall 36 enables to outer tubular wall 32 (and therefore also the discharge pipe 10) to be movable upward or downward between the storage position, open utility position and closed utility position) relative to the non-movable (stationary) tubular attachment wall 37 of the valve 4 (and of course also relative to the non-movable (stationary) base 3 to which the valve 4 is connected).

For opening and closing of the discharge passage, the valve 4 comprises a sealing body 9, preferably a sealing body formed by an elastic ring-shaped seal collar 14 extending outwardly towards the sleeve 6. The sealing body 9 is located at the upstream seal member (upstream end wall 12) of the discharge pipe 10. The seal collar 14 may be formed from a suitable plastics material, which is elastic by nature. As mentioned above, the discharge pipe 10 is also provided with several pipe wall radial openings 16. These radial opening 16 are located immediately downstream of the seal collar 14. Thereby, discharge of a liquid will take place through the pipe wall openings 16 and the discharge pipe 10 when the valve is in the open utility mode. Along its inner periphery, the sleeve 6 is provided with a ring-shaped seal bulb 18 (cf. FIG. 2B, and, in more detail, FIGS. 3A-3C) extending into the sleeve 6. The seal bulb 18 includes an upstream-directed storage seal seat 20 structured for sealing reception of said seal collar 14 when the valve 4 is in the storage mode, such as shown in FIG. 3A. This is possible because the seal collar 14 is located in a region upstream of the seal bulb 18.

Furthermore, the sleeve 6 is provided with an upstream-directed, ring-shaped end seat 22 also located upstream of the seal bulb 18 and being one of several utility seal seats in the sleeve 6. In this embodiment, the end seat 22 is comprised of an upstream-directed bevel edge formed at an upstream end 24 of the sleeve 6. The end seat 22 is structured for sealing reception of the seal collar 14 when the valve 4 is in the closed utility mode, such as shown in FIG. 3C. Thus, the valve 4 is structured for opening of the discharge conduit 8 by virtue of upstream-directed movement of the seal collar 14 relative to the discharge direction of the valve, and away from the end seat 22, in which position the valve 4 is in the open utility mode, such as shown in FIG. 3B. In FIG. 3B, the discharge direction is indicated with downstream-directed arrows 27, whereas the movement direction of the seal collar 14 during valve opening is indicated with an upstream-directed arrow 29.

The seal bulb 18 also includes a downstream-directed, ring-shaped stop seat 26. This stop seat 26 is structured for motion-limiting contact with an external stop collar 28 formed around the discharge pipe 10 in a region located downstream of said pipe wall openings 16 and downstream of the seal bulb 18. FIG. 3B shows the stop collar 28 in contact with the stop seat 26 subsequent to upstream-directed and valve opening axial movement of the discharge pipe 10.

The sleeve 6 also includes an internal and cylindrically shaped seal portion 30 located in a longitudinal portion between said end seat 22 and the seal bulb 18. In this example of an embodiment, the entire seal portion 30 is structured for slide-sealing against the seal collar 14. When in its radially expanded position, this seal collar 14 is arranged to have a marginally larger diameter than the diameter of the internal, cylindrical seal portion 30, such as shown in FIG. 3C. The cylindrical seal portion 30 may thus function both as continuous storage seal seats and utility seal seats, and the seal collar 14 will be somewhat compressed radially when positioned in the seal portion 30. Thus, all of the storage seal seats 20, 30 and utility seal seats 22, 30 are structured for sealing against the seal collar 14 during downstream-directed movement thereof.

The upper part of FIG. 2B illustrates a partly cut-away side view of the sealing device 1 of FIG. 2A, while the lower part of FIG. 2B illustrates a detailed cross-section of the bottom end of the base 3 of the sealing device 1. The base 3 supports the valve 4 and is configured to allow the valve 4 to be positioned in the open utility mode, the closed utility mode and/or the storage mode. To this end, the base 1 comprises a tubular connection portion 11 configured to be mounted to the receptacle 50. The tubular connection portion 11 is connected to or integrally formed with a tubular base wall 7 that is connected to or integrally formed with wall partition 31. Also an upper portion of the wall partition 31 takes a tubular shape and constitutes the sleeve 6 relative to which the discharge pipe 10 may be displaced. The partition wall 31 also is provided with an annular axial rim 2 creating a gap between the outer side of the partition wall 31 of the base 3 and the inner side of the outer tubular wall 32 and flexible (resilient) wall 36 so as to provide sufficient space for the discharge pipe 10 to be moved in axial direction. If an axial force is exerted on the valve 4 in the direction of the upstream end wall 12, for instance by a user pushing his lips onto the valve, the discharge pipe 10 of the valve 4 is moved from the storage mode or closed utility mode to the closed utility mode and/or the open utility mode. Due to resilient properties of wall part 36 of the valve 4 facing the partition 31, the sleeve 6 of the valve 4, after said exertion of force is relieved, may be moved relative to the base 3 from the open utility mode to the closed utility mode.

For example, in FIGS. 2B and 3B, the sealing device 1 is illustrated in the storage mode, said exertion of force may force the upstream end wall 12 in the upstream direction to be moved into the closed utility mode (cf. FIG. 3C), further application of force in said direction may force the upstream end wall 12 to move further in said direction, thereby forcing the sealing device 1 in the open utility mode (cf. FIG. 3C), thereby allowing fluidic flow from a drinking receptacle arranged upstream of the sealing device 1.

In principle, the valve 4 of the first or second embodiment could be placed on the base 3 in a non-fixed manner. For example, the valve 4 and base 3 could be jointly mounted in a cap, a cap-like cover or the like wherein the cap comprises a radially narrowed portion that acts as a seat for the valve collar 13 and/or the base collar 15 to mount the base 3 and the valve 4 in a cap, a cap-like cover or the like in a click-like manner. However, such a manner of mounting may be unreliable, wherein the base 3 and the valve 4 may come loose or lose their sealing properties. Therefore there is a need for fixedly connecting the valve 4 and the base 3 at least in a portion of and/or near the valve collar 13 and the base collar 15.

To achieve a more reliable seal of the sealing device 1 as a whole, it is considered in the present disclosure to fix the valve 4 and the base 3 to each other. The fixed connection may be achieved according to embodiments of the present disclosure by placing a ring-shaped attachment element over both collars 13, 15 and attaching the same to both the base collar 15 of the base 3 and the valve collar 13 of the valve 4. In other embodiments the ring-shaped attachment element may be an integral part of either the base collar 15 or the valve collar 13. In these embodiments the ring-shaped attachment element only needs to be attached to the other collar 13,15.

Referring to FIGS. 1 and 2A-2C, the valve 4 and the base 3 may be connected to each other using a clamping ring 40. The base wall 7 comprises a radially protruding circumferential base collar 15 of the base 3, while the tubular attachment wall 37 of the valve 4 comprises a similar radially extending circumferential valve collar 13. After having placed the valve collar 13 is positioned on the base collar 15, the clamping ring 40 can be placed around the base so to contact both the valve collar 13 and base collar 15. The clamping ring 40 may be connected to both the valve collar 13 and the base collar 15 by any attachment technique, such as gluing and/or welding (for instance heat welding, ultrasonic welding, RF welding, pressure welding and/or impact welding or snap). Preferably, the clamping ring 40 is fixedly connected to the valve collar and/or base collar 15 by ultrasonic welding. The clamping ring 40 preferably comprises at least a portion covering a radially extending portion of the valve collar 13 of the valve 4 and at least a portion fixedly connected to the base collar 15. Thereby movement of the valve collar 13 with respect to the base collar 15 (both axial movement and rotational movement) is prevented.

The clamping ring may be a separate ring that is arranged around the collars 13,15 once they have been placed on top of each other. In other embodiments, the clamping ring 40 is an integrally formed part of either the base collar 15 or the valve collar 13. In the embodiment of FIGS. 2B and 2C the clamping 40 is integrally formed with the base collar 15. The clamping ring 40 only needs to be attached (glued and/or welded) to the other collar, again by gluing and/or welding.

Referring again to the embodiment shown in FIGS. 2B and 2C, the valve 4 and the base 3 are separate elements prior to joining thereof. The clamping ring 40 is integrally formed with the base collar 15 whereby a base collar gap 17 (cf. FIG. 2C) is formed in between a portion of the clamping ring 40 and a portion of the base collar 15, the shape of said gap 17 being such that it substantially corresponds to the shape of the portion of the valve collar 13 to be fitted in the gap 17 and such that, when the valve collar 13 is fitted in said gap 17, axial movement of the valve collar 13 with respect to the base collar 15 is prevented. To this end, when the valve collar 13 is applied in the gap 17, the clamping ring 40 may be configured to have a portion of the clamping ring 40 snap over the valve collar 13, thereby preventing axial movement of the collar 13 with respect to the base collar 15. In addition, the clamping ring 40 may be further fixed to the base collar 15 and/or the valve collar 13. As mentioned before, fixing the clamping ring 40 to the valve collar 13 may be performed by gluing, heat sealing, ultrasonic sealing, RF sealing, pressure sealing and/or impact sealing. Preferably, the clamping ring 40 is fixedly connected to the valve collar 13 by ultrasonic sealing.

Returning to FIG. 2B, alternatively or additionally, the base 3 may at the inner circumference of the base wall 7, more specifically at the inner circumference of the tubular connection portion 11 of the base 3, be attached to a spout seat 5 (corresponding to spout seat 51 in FIG. 1). The spout seat 5 locally decreases the inner diameter of the tubular connection portion 11. The tubular connection portion 11 may be configured to be placed over a receptacle formed by a spout wherein the spout has an outer shape corresponding to the inner shape of the tubular connection portion 11. For example, the inner diameter of the tubular connection portion 11 may correspond to an outer diameter of the spout at which connection portion is to be mounted. The spout may for instance have a substantially cylindrical connection portion (not shown in the figures). Such connection portion preferably comprises a radially protruding portion forming a flange-like protrusion wherein said spout seat 5 is configured to cooperate with said flange to attach the sealing device 1 onto the spout. For instance when the sealing device 1 is mounted on the spout, the spout seat 5 may be snapped over the flange to prevent the sealing device 1 from moving with respect to the spout.

Alternatively or additionally, the tubular connection portion 11 may comprise an inner threading configured to be screwed onto an outer threading of a drinking receptacle. Further alternatively or additionally, as mentioned above, the outer surface of the tubular connection portion 11 may be configured to be fitted in the inner circumference of a connection portion of a receptacle.

Figure 4A:
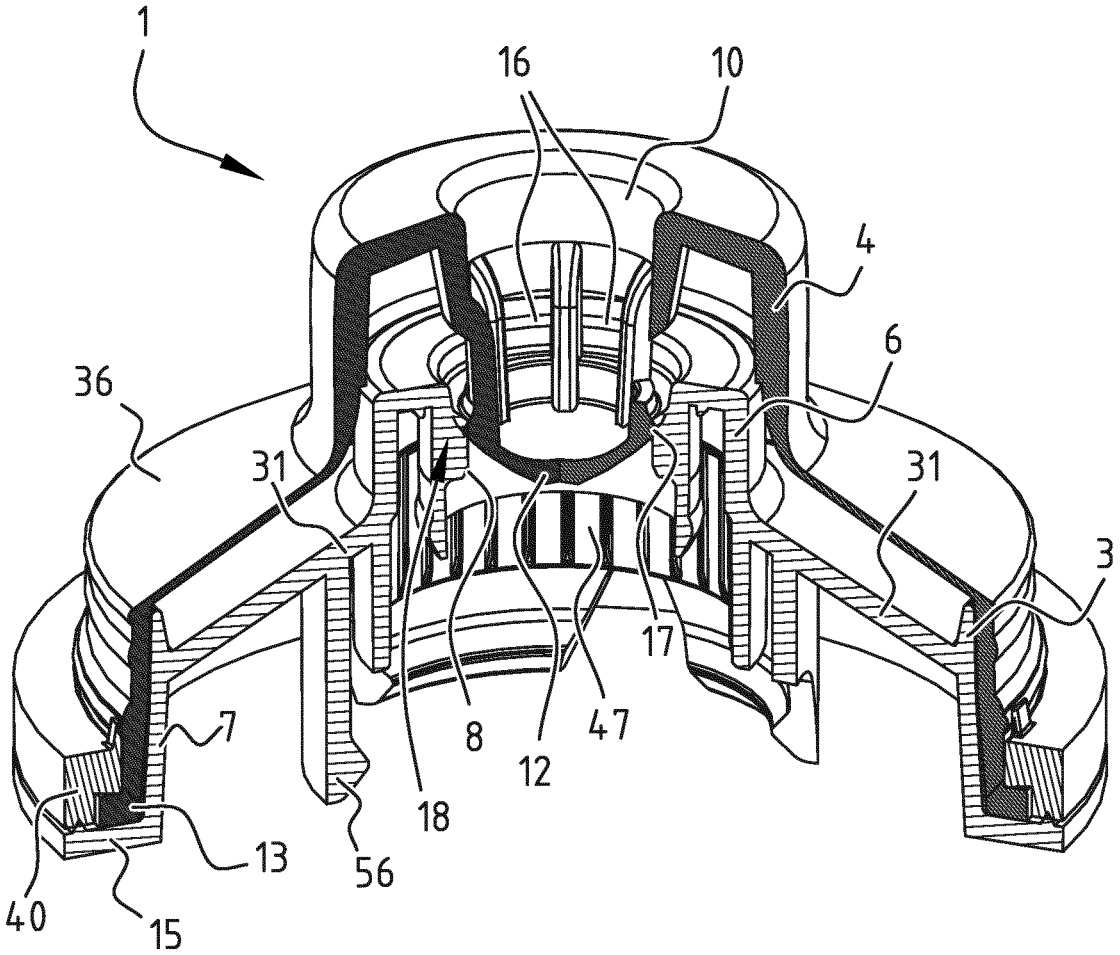
FIG. 4A and FIG. 4B show a cut-away side view and an exploded view of a further embodiment of the sealing device, respectively.
Figure 4B:
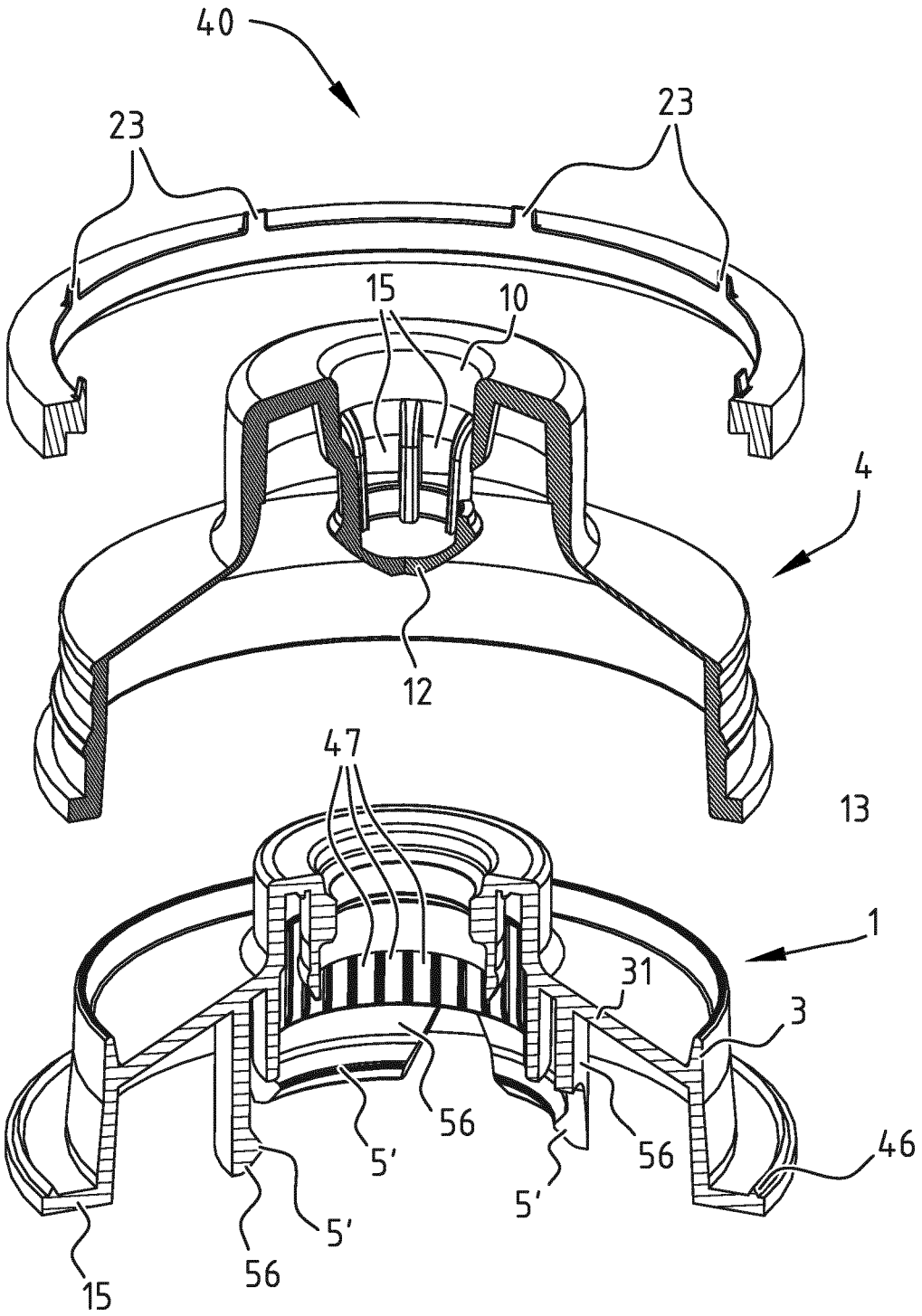

FIGS. 4A-4B show partly cut-away perspective views of another embodiment of the sealing device. Like elements have been provided with like reference numbers and a separate detailed description thereof has been omitted. The difference between the embodiment of FIGS. 4A and 4B and the embodiment of FIGS. 1, 2A-2C mainly resides in the features relating to the tubular base wall 7 and/or connection portion 11 (cf. FIGS. 2A-2C) and connection portion 56 (cf. FIGS. 4A-4B, similar to the connection portion shown in FIG. 1), 11' and the corresponding spout seat 5'. Similar to the embodiment of FIG. 1, the embodiment of FIGS. 4A-4B has a connection portion 56 for snap-fitting on a connection portion 49 on the tubular spout member 54 of a spout type receptacle 50.

Further, the embodiment of FIGS. 4A-4B comprises one or more base anti-rotation ribs and/or grooves 47, also discussed in connection with FIG. 1. The ribs/grooves 47 may also be applied in each of the other embodiments described herein.

The connection portion 56 of FIGS. 4A-4B is configured to receive a connection portion of a spout therein. The connection portion 56 has a reduced inner diameter with respect to the tubular base wall 7. To this end, the connection portion 56 is connected to the base 3 by an axial tubular flange starting from the bottom surface of the partition wall 31 and extending downward. The outer end of this axial tubular flange is formed by the connection portion 56. The connection portion 56 is configured to have an inner diameter matching an outer diameter of a connection portion of a receptacle, for instance—but not limited to—the receptacle of FIG. 1, at which the sealing device 1 is to be mounted. The upstream portion of the connection portion 56 may comprise a spout seat 5' with similar purpose as the spout seat 5 shown in FIG. 1. The spout seat 5' may be discontinuous along the upstream portion of the connection portion 56 in order to allow the connection portion 56 to temporarily deform in order to accommodate a snapping locking action of the spout seat 5' over the flange-like protrusion 49 of the receptacle 50.

In FIG. 4B another construction for mounting the valve 4 to the base 3 is illustrated. The base 3 may comprise a radially protruding base collar 15 that has an increased outer diameter with respect to the outer diameter of the valve collar 13. The base collar 15 may comprise one or more welding ridges 46, i.e. a locally increased thickness of the base collar 15, wherein the welding ridges 46 are configured to assist the welding operation. In the exemplary embodiment of FIG. 4B, one continuous welding ridge 46 is illustrated; however the person skilled in the art will recognize that a plurality of welding lines may also be applied. The welding line 46 may be a continuous or a discontinuous welding line and may be positioned on a portion of the base collar 15 that is extending further in the radial direction than the radially outermost portion of the valve collar 13. The clamping ring 40, illustrated as a separate element, may be provided on the valve 4 and the base 3. The clamping ring 40 will be in contact with the base 3 via the base collar 15 at the position of the welding line 46. The clamping ring 40 is connected to the base collar 15 via gluing, heat welding, ultrasonic welding, RF welding, pressure welding and/or impact welding, preferably ultrasonic welding. The clamping ring 40 comprises a portion that is covering at least a portion of the valve collar 13 in the axial direction of the sealing device 1. Thereby axial and rotational movement of the valve collar 13 with respect to the base collar 15 is prevented.

In FIG. 4B a plurality of optional cap connectors 23 are illustrated on the clamping ring 40. The cap connectors 23 may be integrally formed with the clamping ring 40 or may be separate elements configured to allow connection of a cap to the valve 4 and/or base. Alternatively or additionally the cap connectors 23 are integrally formed with both the cap and the clamping ring 40 so that they form one interconnected unit. For instance, the cap connectors 23 can be configured to connect with the dust cap 60 as illustrated in FIG. 5. This figure is a perspective view of the sealing device 1 of FIGS. 4A and 4B. In FIG. 5 the sealing device 1 is provided with a cap 60 that may prevent dust, solids, fluids, bacteria or other unwanted substances from coming into contact with the valve 4 of the sealing device 1. Additionally, the cap 60 may, for example, prevent the valve 4 of the sealing device 1 to be unintentionally pushed into the open utility mode or, when the sealing device 1 is in the storage mode, prevent that the sealing device 1 is unintentionally pushed into the closed utility mode. The cap 60 may be mounted on the clamping ring 40 in a removable manner, for instance via the cap connectors 23. To this end the cap connectors 23 may be connected to the cap 60 in a manner that a pull action on the cap 60 may break the connections of the cap connectors 23 to the cap 60. Alternatively or additionally, the dust cap may be mounted in a flipable manner on the clamping ring 40 or the dust cap comprise two dust cap parts: a first part permanently or removably connected to the clamping ring, and a second part hingedly connected to the first cap part allowing the second part to be moved between a closed and open position.

Figure 6A:
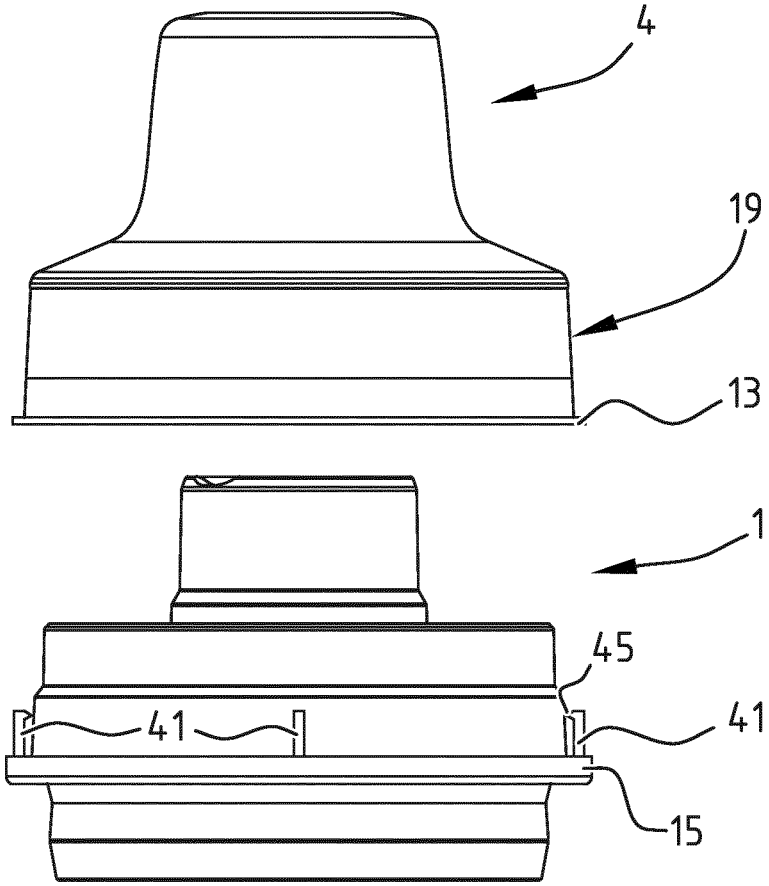
FIG. 6A, FIG. 6B, and FIG. 6C illustrate further embodiments of the sealing device and different manners of attaching a valve.[1]
Figure 6B:
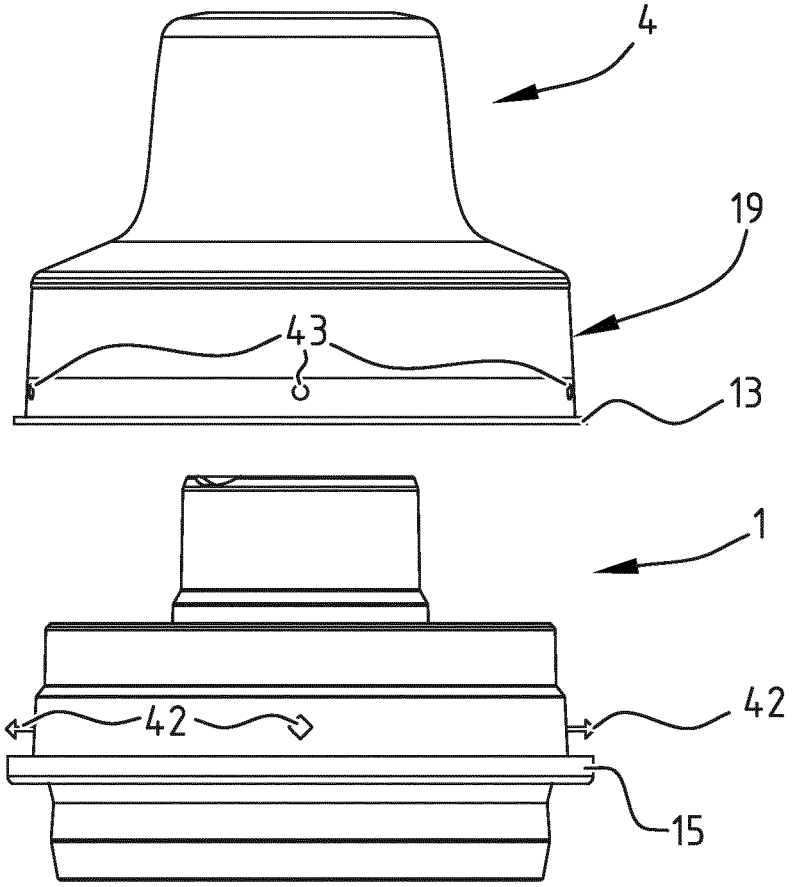
Figure 6C:
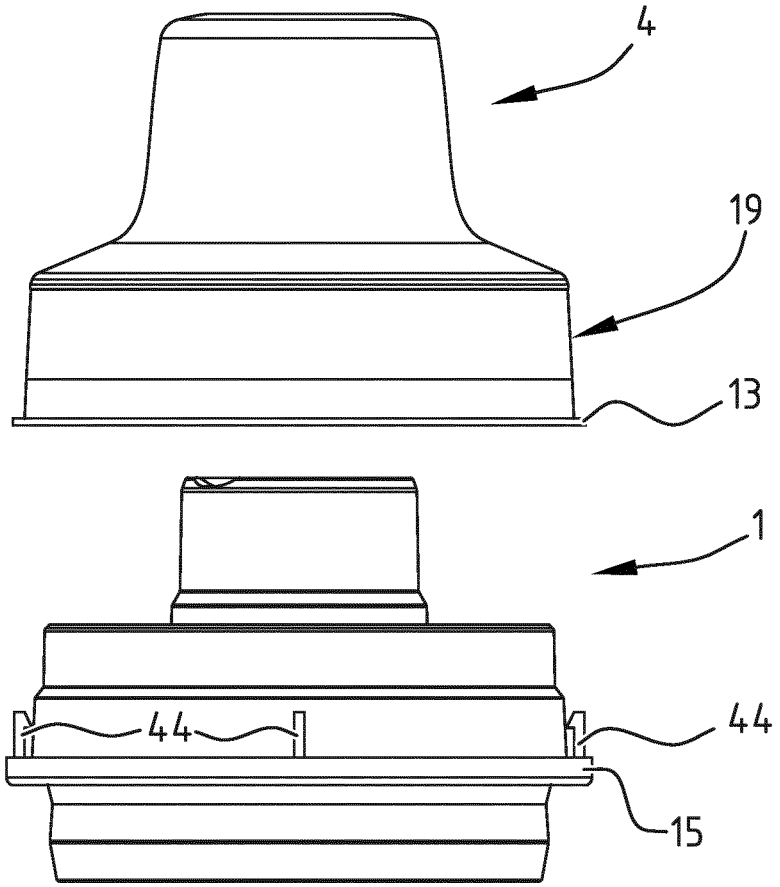

FIGS. 6A-6C illustrate further embodiments of the sealing device, wherein different manners of attaching a valve to a base are elucidated.

In FIG. 6A, a plurality of welding elements 41 are illustrated. The welding elements 41 are integrally formed with the base 3 prior to connection thereof to the valve 4. During connection of the base 3 and the valve 4, the welding elements 41 may be connected to an upstream side of the valve 19, these welding elements 41 may be connected to the upstream side of the valve 19 by gluing, heat welding, ultrasonic welding, RF welding, pressure welding and/or impact welding, preferably ultrasonic welding. Due to such connections movement of the valve collar 13 with respect to the base collar 15 is prevented.

In addition, in some embodiments, the upstream side of the valve 19 may comprise a plurality of holes (not shown) at positions corresponding to the position of the welding elements 41 to allow at least a welding tip 45 of the welding element 41 to protrude through said hole such that a welding element 41 may also be connected to the base 3 at a portion thereof facing said welding tip 45.

The person skilled in the art will recognize that the welding elements 41 may alternatively be positioned on the valve 4, for example, the welding elements may be arranged in the upstream side of the valve 19 in replacement of the valve collar.

In FIG. 6B, a plurality of connection elements 42 are illustrated. The connection elements 42 are integrally formed with the base 3 prior to connection thereof to the valve 4. During connection of the base 3 and the valve 4, the connection elements 42 may be connected to an upstream side of the valve 19, these connection elements 42 may be connected to the upstream side of the valve 19 by forcing an arrow shape-like end of an connection element 42 through a corresponding connection hole 43 in the upstream side of the valve 19. Preferably, the arrow shape-like head of the connection element 42 has a similar but slight preferably larger maximum diameter than the diameter of the hole such that, after the connection element 42 is forced through the connection hole 43 reversal thereof is difficult to achieve. Due to such connections movement of the valve collar 13 with respect to the base collar 15 is prevented. In addition, in some embodiments, the connection elements 42 may be welded to the valve 4.

The person skilled in the art will recognize that the connection elements 42 may alternatively be positioned on the base collar 15 facing the valve collar 13 and/or the valve 4, for example, on the valve collar 13 facing the base collar 15. In such embodiments the connection holes would be positioned at corresponding positions in the valve collar 13 and/or base collar 15.

In FIG. 6C, a plurality of clamping elements 44 are illustrated. The clamping elements 44 are integrally formed with the base 3 prior to connection thereof to the valve 4.

During connection of the base 3 and the valve 4, the clamping elements 44 may be connected to an upstream side of the valve 19, these clamping elements 44 may be connected to the upstream side of the valve 19 by forcing the valve collar 13 past an inwardly pointed protrusion of the clamping elements 44. As a consequence thereof, the valve collar 13 is clamped to the base 3 via the clamping elements 44. Thereby movement of the valve collar 13 with respect to the base collar 15 is prevented. In addition, in some embodiments, the clamping elements 44 may be welded to the valve 4. The person skilled in the art will recognize that clamping elements 44 may alternatively be positioned on the valve collar 13 facing the base collar 15.

Preferably, the sealing device and the valve are structured for releasable connection to the drinking receptacle, for example via a suitable enclosure. Opening and closing of the valve may be carried out manually, but valve activating auxiliary mechanisms known per se may also be used for this purpose.

It is to be understood that the terminology used herein is for the purpose of describing particular aspects only, and is not intended to be limiting, since the scope of the present disclosure will be limited only by the appended claims.

The invention claimed is:

1. A sealing device for sealing a receptacle, the sealing device comprising:

a base structured to be mounted to the receptacle, the base comprising a radially protruding base collar, and a sleeve forming a discharge conduit;

a valve comprising a radially protruding valve collar, wherein when the base is mounted to the receptacle, the receptacle is located upstream of the valve and a discharge direction of the receptacle defines a downstream direction, opposite an upstream direction; and a ring fixedly attached to the base collar by a weld or glue or integrally formed with the base collar, wherein:

the base collar and the valve collar define a portion of the sealing device remote from the discharge conduit, the valve further comprises comprising discharge pipe at least partially protruding in the sleeve and being axially movable therein in the upstream direction and the downstream direction for opening and closing the valve, the valve is attached to the base at the portion of the sealing device remote from the discharge conduit, and the ring fixes the valve collar to the base collar by clamping or via a weld or glue.

2. The sealing device according to claim 1, wherein:

the base comprises a tubular base wall and the valve comprises a tubular attachment wall, the tubular attachment wall of the valve is configured to be arranged over the tubular base wall of the base, the tubular attachment wall is configured to be attached to the tubular base wall at a portion remote from the discharge conduit, and the tubular base wall of the base is configured to snugly fit inside the tubular attachment wall of the valve.

3. The sealing device according to claim 1, wherein the base comprises a stationary base housing comprising at least a partition wall and a tubular base wall, the valve comprises a stationary valve housing to be attached the base housing, and the stationary valve housing comprises a tubular attachment wall, and wherein the valve is attached with a lowermost portion of the tubular attachment wall to the tubular base wall of the base, the valve being attached with the lowermost portion of the tubular attachment wall to a lowermost portion of the tubular base wall of the base.

4. The sealing device according to claim 1, wherein the base comprises a partition wall and a tubular base wall, the partition wall comprising an annular axial rim creating a gap between an outer side of the partition wall of the base and an inner side of an outer tubular wall and a flexible wall so as to provide sufficient space for the discharge pipe to be moved in axial direction.

5. The sealing device according to claim 1, wherein a base collar extends along an entire circumference of the base along a circumferential bottom edge of a tubular base wall of the base, and/or wherein a valve collar extends along an entire circumference of the valve along a circumferential bottom edge of a tubular attachment wall of the valve.

6. The sealing device according to claim 1, wherein:

the base collar is attached directly to the valve collar, or the base collar is attached indirectly to the valve collar via a ring-shaped attachment.

7. The sealing device according to claim 1, wherein the ring is pivotably attached to or pivotably formed with the base collar or the valve collar.

8. The sealing device according to claim 1, wherein the base collar comprises one or more welding elements configured to connect to the ring via an ultrasonic weld.

9. The sealing device according to claim 1, wherein:

the base collar is provided with one or more welding elements pointing in a downstream direction of the sealing device, and the welding elements are configured to be welded to a side of the valve.

10. The sealing device according to claim 1, wherein:

one or more of the following is provided with one or more connection elements: the base, the base collar, the valve collar, or an upstream side of the valve, a portion of the base, the base collar, the valve collar, and/or the upstream side of the valve is provided with one or more connection holes, the connection holes are provided in the portion of the base, the base collar, the valve collar, and/or the upstream side of the valve that is opposite to a position where the one or more connection elements are arranged, the connection holes are configured to allow the connection elements to protrude through the connection holes, and the connection holes and connection elements are configured to co-operatively fix the valve to the base.

11. The sealing device according to claim 1, wherein the fixes the valve collar to the base collar in a click-like-manner.

12. The sealing device according to claim 1, wherein the sealing device is configured to allow movement of the discharge pipe between different positions, including:

a closed utility position; and an open utility position, wherein:

in the closed utility position, the sealing device is configured to provide a seal, in the open utility position, the sealing device is configured to provide a substantially free liquid passage through the discharge conduit, the different positions may additionally comprises a closed storage position, and the valve of the sealing device is more firmly held in the closed storage position than in the closed utility position.

13. The sealing device according to claim 1, wherein:

the discharge pipe comprises a sealing body of a radially flexible arrangement, the sealing body being configured to cooperate with the sleeve for opening and closing of the discharge conduit, the discharge pipe is configured to be axially movable between:

a storage position wherein the discharge pipe has been moved in the downstream direction to contact a storage seal seat of the sleeve to close the discharge conduit, an open utility position wherein the discharge pipe has been moved in upstream direction to open the discharge conduit, and a closed utility position, arranged between the storage position and the open utility position, wherein the discharge pipe has been moved to contact a utility seal part of the sleeve to close the discharge conduit, the utility seal part comprises at least one of an end seal seat and an internal ring-shaped seal portion of the sleeve to be contacted by the sealing body of an axially movable discharge pipe to seal off the discharge conduit, and the valve comprises a resilient valve part configured to move the valve relative to the base from an open utility mode to a closed utility mode after an external force is relieved, the external force having moved the valve from the closed utility mode to the open utility mode.

14. The sealing device according to claim 1, wherein:

the base comprises a plurality of base anti-rotation grooves extending in a direction parallel to the downstream direction in an inner portion of the base, and the base anti-rotation grooves are configured to cooperate with spout anti-rotation grooves of a spout whereon the sealing device can be mounted.

15. An assembly of the sealing device according to claim 1 and a receptacle, wherein:

the sealing device is mounted on the receptacle, the receptacle comprises a spout, a base of the sealing device comprises a plurality of base anti-rotation grooves extending in a direction parallel to the downstream direction of the sealing device and being arranged in an inner portion of the base, the spout comprises spout anti-rotation grooves, and the base anti-rotation grooves are configured to cooperate with the spout anti-rotation grooves of the spout whereon the sealing device is mounted.

16. A method of producing a sealing device, the method comprising:

providing a base, a valve, and a ring that jointly form a sealing device;

arranging the valve on the base, wherein:

the base comprises a radially protruding base collar and a sleeve forming a discharge conduit, the valve comprises a radially protruding valve collar, a discharge pipe at least partially protruding in the discharge conduit of the base, and an end wall mounted on an upstream end of the discharge pipe, the base collar and the valve collar define a portion of the sealing device remote from the discharge conduit, the end wall of the discharge pipe is configured to, at least in one mode of the sealing device, cooperate with the discharge conduit to thereby seal the discharge conduit, the ring is fixedly attached to the base collar by a weld or glue or is integrally formed with the base collar, the base is configured to be mounted on a receptacle, and when the base is mounted to the receptacle, the receptacle is located upstream of the valve and a discharge direction of the receptacle defines a downstream direction, opposite an upstream direction; and fixedly attaching the valve to the base at the portion of the sealing device remote from the discharge conduit, wherein the ring fixes the valve collar to the base collar by clamping or via a weld or glue.

17. The method according to claim 16, wherein:

producing the sealing device is performed at a manufacturing site, and an attachment of the sealing device to the receptacle is performed at an assembly site, remote from the manufacturing site.

18. The sealing device according to claim 1, wherein:

the ring comprises a portion configured to cover at least a portion of the valve collar in an axial direction of the sealing device, and the valve collar is surrounded by the portion configured to cover at least the portion of the valve collar so that axial and rotational movement of the valve collar with respect to the base collar is prevented.

19. The sealing device according to claim 6, wherein the ring-shaped attachment comprising a clamping ring.

* * * * *